US005931130A

United States Patent [19]

Lucarini

[11] Patent Number: 5,931,130

[45] Date of Patent: Aug. 3, 1999

[54] DESMODROMIC DISTRIBUTION SYSTEM FOR FOUR-STROKE ENGINES

[76] Inventor: Luca Lucarini, Via Calabria, 10, Falconara (AN), Italy

[21] Appl. No.: 09/068,913

[22] PCT Filed: Nov. 15, 1996

[86] PCT No.: PCT/IT96/00213

§ 371 Date: May 18, 1998

§ 102(e) Date: May 18, 1998

[87] PCT Pub. No.: WO97/19259

PCT Pub. Date: May 29, 1997

[30] Foreign Application Priority Data

Nov. 20, 1995 [IT] Italy ..... AN95A0055

[51] Int. Cl.[6] ..... F01L 1/30

[52] U.S. Cl. ..... 123/90.24; 123/90.26

[58] Field of Search ..... 123/90.24, 90.25, 123/90.26

[56] References Cited

U.S. PATENT DOCUMENTS

| | | | |
|---|---|---|---|
| 2,831,470 | 4/1958 | Lorscheidt | 123/90.24 |
| 4,887,565 | 12/1989 | Bothwell | 123/90.26 |
| 4,928,650 | 5/1990 | Matayoshi et al. | 123/90.24 |
| 5,048,474 | 9/1991 | Mayayoshi et al. | 123/90.24 |

*Primary Examiner*—Weilun Lo
*Attorney, Agent, or Firm*—Leonard Bloom

[57] ABSTRACT

This invention concerns a desmodromic distribution system for four-stroke engines characterized by an articulated joint between the tappet and valve, achieved by means of a special joint.

1 Claim, 3 Drawing Sheets

FIG. 2
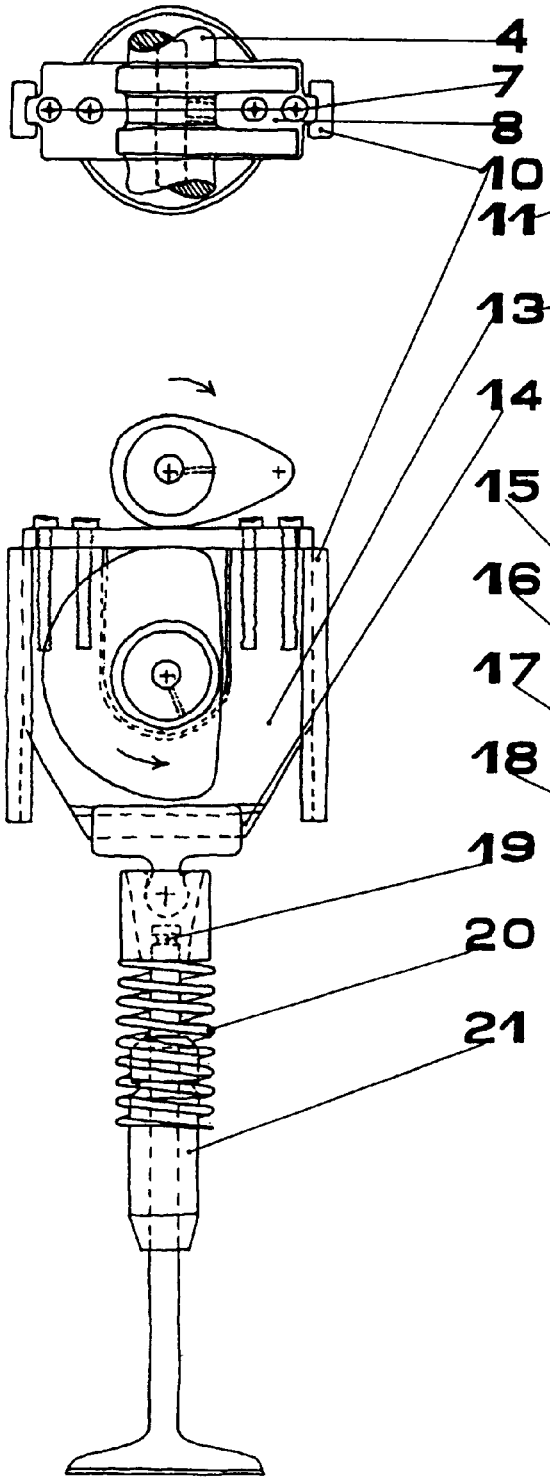
FIG. 4
FIG. 3
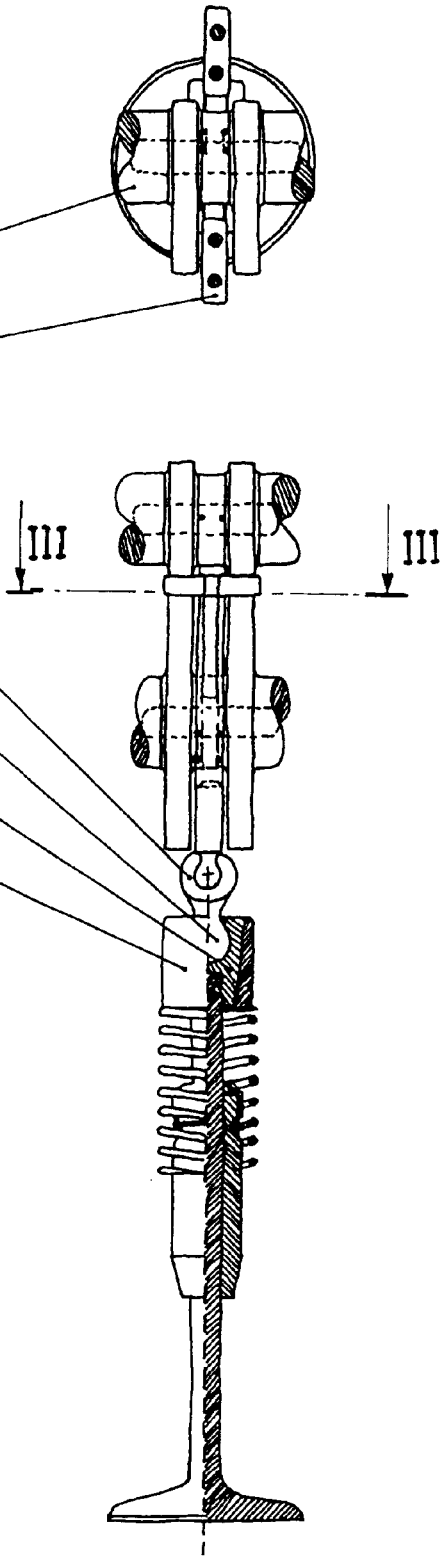
FIG. 5

DESMODROMIC DISTRIBUTION SYSTEM FOR FOUR-STROKE ENGINES

This patent application concerns a desmodromic distribution system for four-stroke engines consisting of an articulated joint between tappet and valve.

It is common knowledge that in desmodromic distribution systems, the opening and closing of the valve is performed by means of two camshafts, whose cams act on the same tappet, connected solidly to the stem of the respective valve, and whose alternating strokes consequently follow those of the tappet.

The solid connection between the tappet and valve causes problems when the engine runs at high speed due to the minor distortions that may occur—as a result of the thermal expansion of the transmission components between the sliding axle of the tappet and that of the respective valve.

More specifically, even minor distortions cause serious stress on the valve, on which the tappet discharges a force having a non null transverse component with respect to the sliding axle of the valve.

The scope of this invention is to prevent these problems by introducing an articulated joint between the tappet and the respective valve, able to support minor distortions between the tappet and the valve so that the force transmitted by the tappet to the valve is always perfectly directed along the sliding axle of the valve itself.

This articulated joint consists of a special joint, having a hollow cylinder whose surface is at one end characterised by a longitudinal through slot, and on the opposing end, by a mushroom-shaped element with ball head projecting externally. A cylindrical groove which can house and slide inside the cylinder being provided on the tappet; the longitudinal axle of said cylindrical groove being perpendicular to the sliding axle of the tappet.

The spherical head of said mushroom-shaped element, on the other hand, houses exactly inside a conforming housing within a pair of cotters designed to connect to the top of the valve stem.

The coupling between the cylindrical groove of the tappet and the cylindrical housing of said special joint allows the tappet to translate in a direction orthogonal to the sliding axis of the valve.

The ball coupling between the pair of cotters and the mushroom-shaped element of the special joint in question allows angular deviations of the sliding axis of the tappet with respect to the sliding axis of the valve.

For major clarity the description continues with reference to the enclosed drawings which are intended for purposes of illustration and not in a limiting sense where:

FIGS. 2, 4 and 5 are three orthogonal projections showing the mechanical components utilised by the desmodromic distribution system according to the invention;

FIG. 3 is a cross-section of FIG. 5 with plane III—III;

Figure 1:
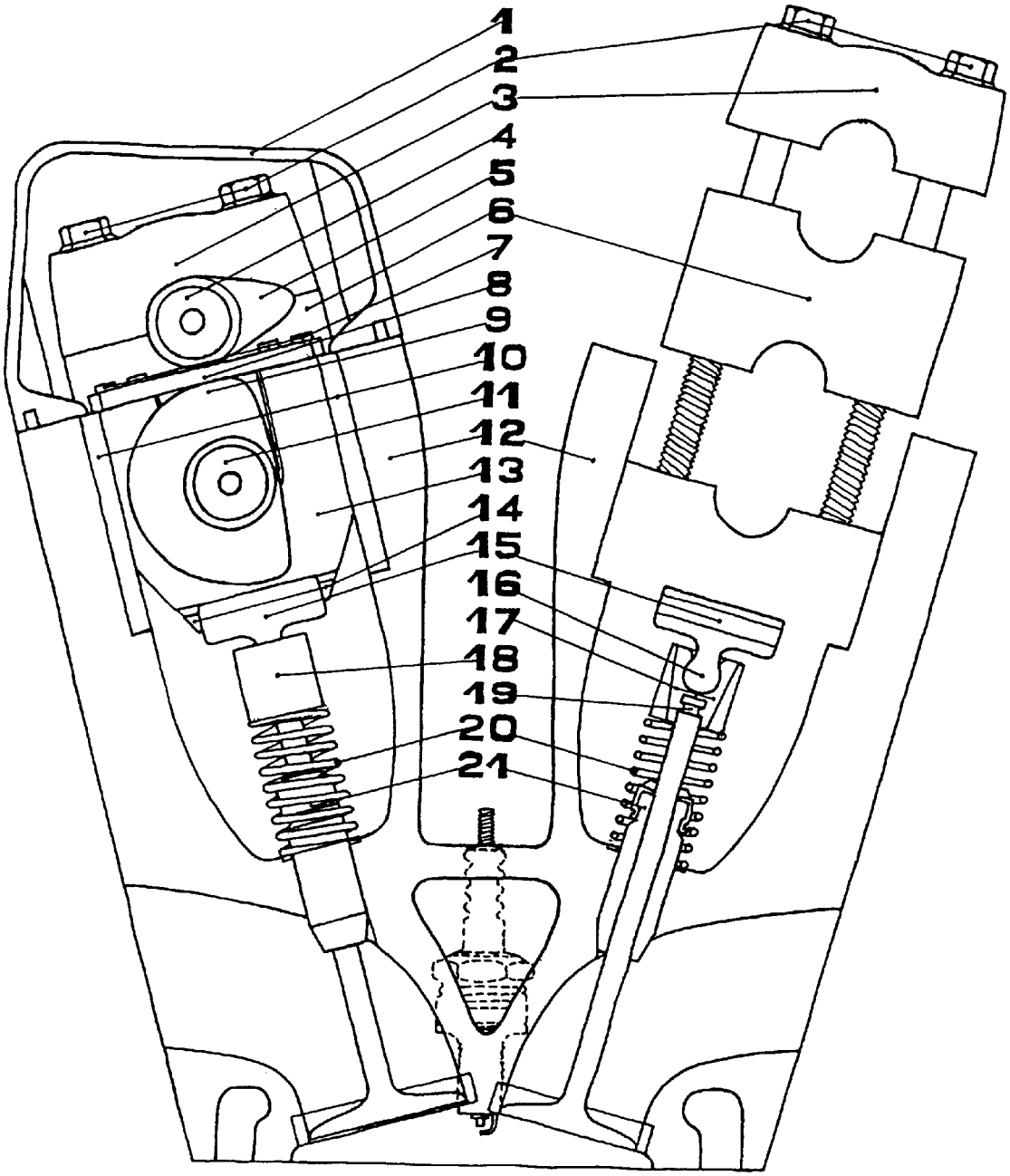
FIG. 1 is a schematic view of the transverse section of the head of a four-stroke engine using the desmodromic distribution system according to the invention.

The parts numbered and represented in FIG. 1 are as follows

1: Head cover which also fastens the "U" shaped tappet guide foils (10);
2: Clamping screws of caps (3);
3: Thrust cap having a seat for the upper camshaft (4);
4: Upper camshaft (4);

5: Eccentric or thrust cam of shaft (4);
6: Return cap equipped with two seats, one for the upper shaft (4) and one for the lower shaft (11);
7: Cheese-head screws for clamping the tappet cap (8)
8: Cap fixed on the tappet;
9: Eccentric or return cam (11);
10: Gauged "U"-shaped tappet guide fillets;
11: Lower camshaft;
12: Head;
13: "U"-shaped tappet known as bell-rod;
14: Cylindrical groove at the base of the tappet (13);
15: Articulated joint between tappet and valve;
16: Mushroom-shaped element with articulated head projecting from the joint (15);
17: Pair of cotters connecting both to the mushroom-shaped element and to the valve stem;
18: Cup which houses and fastens the pair of cotters (17);
19: Valve stem having a semi-circular groove at its upper end;
20: Spring fitted on the stem of the valve between the cup (18) and the valve-guide (21);
21: Valve-guide;

FIG. 2 is a top view of the distribution system shown in FIG. 4; FIG. 2 shows the following:

the upper camshaft (4);
the tappet guide (10);
the cap (8) fixed on the tappet by means of clamping screws (7).

FIG. 3 shows the lower camshaft (11).

Figure 6:
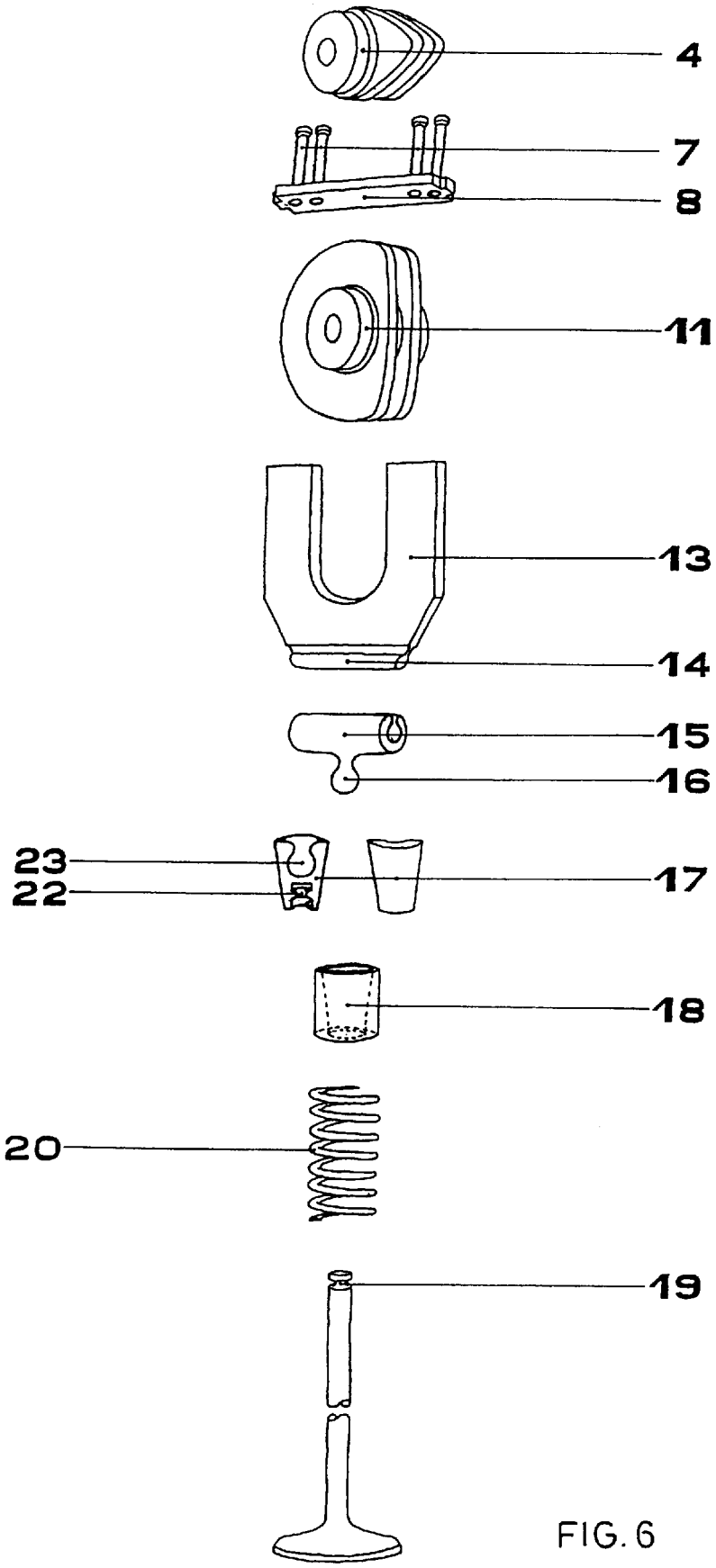
FIG. 6 is an axonometric exploded view of the mechanical components utilized by the desmodromic distribution system according to the invention.

FIG. 6 shows the following:

upper camshaft (4);
gauged cap (8) with relevant clamping screw (7);
lower camshaft (11);
tappet (13) with relevant cylindrical groove (14) at the bottom;
joint (15) consisting of a hollow cylinder with longitudinal through slot which allows the above cylindrical groove (14) to fit into the cylindrical duct of the joint (15);
mushroom-shaped element (16) with spherical head realised in a single part with the joint (15), in opposing position with respect to the longitudinal through slot;
pair of cotters (17) characterised internally by a pair of semi-spherical cavities (23) designed to form together a spherical seat in which the ball head of the mushroom-shaped element (16) can house as well as a pair of semicircular cavities (22) designed to fasten the stem of the valve (19) whose end has an annular connection groove for this purpose;
the cup (18) consisting of a collar with truncated-conical cavity designed to house and fasten the pair of cotters (17);
the spring (20) whose purpose is to drive the cup (18) constantly towards the pair of cotters (17).

It is now much clearer from the description referring to the above figures how the articulated joint between tappet and valve is achieved in the desmodromic distribution system according to the invention.

The coupling between the cylindrical groove (14) of the tappet (13) and the cylindrical seat of the joint (15) allows the tappet (13) to translate in an orthogonal direction with respect to the sliding axis of the valve (19).

The spherical coupling between the pair of cotters (17) and the mushroom-shaped element (16) of the joint (15) allows angular deviations of the sliding axle of the tappet (13) with respect to the sliding axle of the valve (19).

I claim:

1. A desmodromic distribution system for four-stroke engines, consisting of a tappet (13) co-operating with two camshafts, an upper thrust camshaft (4) and a bottom return camshaft (11), characterised in that the tappet (13) is connected by means of an articulated joint to the valve (19) with a mechanism consisting of the following:

a joint (15) consisting of a hollow cylinder whose lateral surface on one side features a longitudinal through slot and on the opposing side a mushroom-shaped element (16) having a ball head, which projects externally;

a pair of cotters (17) featuring internally a pair of semi-spherical cavities (23) designed to form together a spherical seat in which the ball head of the mushroom-shaped element (16) can house, as well as a pair of semicircular cavities (22) designed to fasten the stem of the valve (19) whose end has an annular connection groove for this purpose;

a cup (18) consisting of a collar with truncated-conical cavity designed to house and fasten the pair of cotters (17);

a spring (20), fitted on the stem of the valve (19) positioned between the cup (18) and the valve guide (21);

the tappet (13) being provided at the bottom with a cylindrical groove (14) positioned with its longitudinal axle in a direction orthogonal to the sliding axle of the tappet (13) and dimensioned to fit exactly into the slot of the joint (15).

* * * * *